US008834225B2

(12) United States Patent
Ferron

(10) Patent No.: US 8,834,225 B2
(45) Date of Patent: Sep. 16, 2014

(54) CREATURE CONSTRUCTION TOY

(75) Inventor: Robert William Ferron, Kansas City, MO (US)

(73) Assignee: Tangerine Creative, LLC, Kansas City, MO (US)

( * ) Notice: Subject to any disclaimer, the term of this patent is extended or adjusted under 35 U.S.C. 154(b) by 128 days.

(21) Appl. No.: 13/570,053

(22) Filed: Aug. 8, 2012

(65) Prior Publication Data

US 2013/0040531 A1 Feb. 14, 2013

Related U.S. Application Data

(60) Provisional application No. 61/521,301, filed on Aug. 8, 2011.

(51) Int. Cl.

| | |
|---|---|
| ***A63H 33/04*** | (2006.01) |
| ***A63H 33/10*** | (2006.01) |
| ***A63H 3/16*** | (2006.01) |
| ***A63H 3/46*** | (2006.01) |

(52) U.S. Cl.

CPC ..... *A63H 3/16* (2013.01); *A63H 33/107* (2013.01); *A63H 3/46* (2013.01)

USPC ..... 446/97; 446/117; 446/124

(58) Field of Classification Search

CPC ..... A63H 33/04; A63H 33/10; A63H 33/108

USPC ..... 446/97, 108, 111, 117, 124, 128

See application file for complete search history.

(56) References Cited

U.S. PATENT DOCUMENTS

| | | | |
|---|---|---|---|
| 2003/0064656 | A1 | 4/2003 | Johnson |
| 2004/0198156 | A1 | 10/2004 | Theel |

FOREIGN PATENT DOCUMENTS

| | | |
|---|---|---|
| JP | 63038596 | 3/1988 |
| JP | 2002325981 | 11/2002 |

OTHER PUBLICATIONS

International Search Report and Written Opinion from PCT Application No. PCT/US2012/05000 entitled Creature Construction Toy (Dated Feb. 28, 2013).

*Primary Examiner* — John Ricci

(74) *Attorney, Agent, or Firm* — Hovey Williams LLP

(57) ABSTRACT

A modular construction toy kit includes components to construct a modular construction toy. The toy kit includes at least three contoured body sections operable to be interconnected in series with one another to cooperatively form a continuous toy body. The body sections include at least one transition body section and a pair of end body sections. Each end body section is truncated to present a contoured outer end surface that is intersected by an end joining face. The end joining faces have different marginal shapes and/or sizes. The at least one transition section presents a contoured outer transition surface and opposite, endmost transition joining faces that intersect the outer transition surface. Each endmost transition joining face marginally matches a respective one of the end joining faces to define a connection interface.

38 Claims, 10 Drawing Sheets

CREATURE CONSTRUCTION TOY

RELATED APPLICATION

This application claims the benefit of U.S. Provisional Application Ser. No. 61/521,301, filed Aug. 8, 2011, entitled CREATURE CONSTRUCTION TOY, which is hereby incorporated in its entirety by reference herein.

BACKGROUND

1. Field

The present invention relates generally to toy construction sets. More specifically, embodiments of the present invention concern a construction toy kit for building a toy creature.

2. Discussion of Prior Art

Toy construction sets have been available for many years. Prior art sets can be used to build a variety of toy structures, such as a building or a vehicle. Conventional sets typically include numerous blocks that are removably stacked and attached to one another to cooperatively form a larger structure. Such blocks are known to have different forms, such as a cuboid or a cylinder.

However, conventional toy construction sets have certain deficiencies. For instance, it is difficult to form large curved bodies by interconnecting multiple components, such as blocks, of prior art construction sets. Furthermore, prior art blocks are unable to cooperatively form a structure, with the blocks cooperatively presenting one or more contoured surfaces of the structure.

SUMMARY

The following brief summary is provided to indicate the nature of the subject matter disclosed herein. While certain aspects of the present invention are described below, the summary is not intended to limit the scope of the present invention.

Embodiments of the present invention provide a construction toy that does not suffer from the problems and limitations of the prior art construction toys set forth above.

A first aspect of the present invention concerns a modular construction toy kit that broadly includes at least three contoured body sections. The contoured body sections are operable to be interconnected in series with one another to cooperatively form a continuous toy body, wherein the body has opposite body ends and an exposed contoured outer body surface that extends substantially continuously between the ends. The body sections include at least one transition body section and a pair of end body sections. Each of the end body sections is truncated so as to present a contoured outer end surface that is intersected by an end joining face, with the outer end surface being operable to define part of the body surface at one of the body ends. The end joining faces of the end body sections have different marginal shapes and/or sizes. The at least one transition section presents a contoured outer transition surface operable to define part of the body surface between the body ends. The at least one transition section includes opposite, endmost transition joining faces that intersect the outer transition surface. Each endmost transition joining face marginally matches a respective one of the end joining faces to define a connection interface, with the joining faces associated with each connection interface being substantially coterminous so that the body surface extends substantially continuously across the connection interfaces when the body sections are interconnected.

A second aspect of the present invention concerns a modular construction toy that broadly includes at least three contoured body sections. The contoured body sections are removably interconnected in series with one another to cooperatively form a continuous toy body, wherein the body has opposite body ends and an exposed contoured outer body surface that extends substantially continuously between the ends. The body sections include at least one transition body section and a pair of end body sections. Each of the end body sections is truncated so as to present a contoured outer end surface that is intersected by an end joining face, with the outer end surface defining part of the body surface at one of the body ends. The end joining faces of the end body sections have different marginal shapes and/or sizes. The at least one transition section presents a contoured outer transition surface that defines part of the body surface between the body ends. The at least one transition section includes opposite, endmost transition joining faces that intersect the outer transition surface. Each endmost transition joining face marginally matches a respective one of the end joining faces to define a connection interface, with the joining faces associated with each connection interface being substantially coterminous so that the body surface extends substantially continuously across the connection interfaces.

Other aspects and advantages of the present invention will be apparent from the following detailed description of the preferred embodiments and the accompanying drawing figures.

BRIEF DESCRIPTION OF THE DRAWING FIGURES

Preferred embodiments of the invention are described in detail below with reference to the attached drawing figures, wherein.

Figure 1:
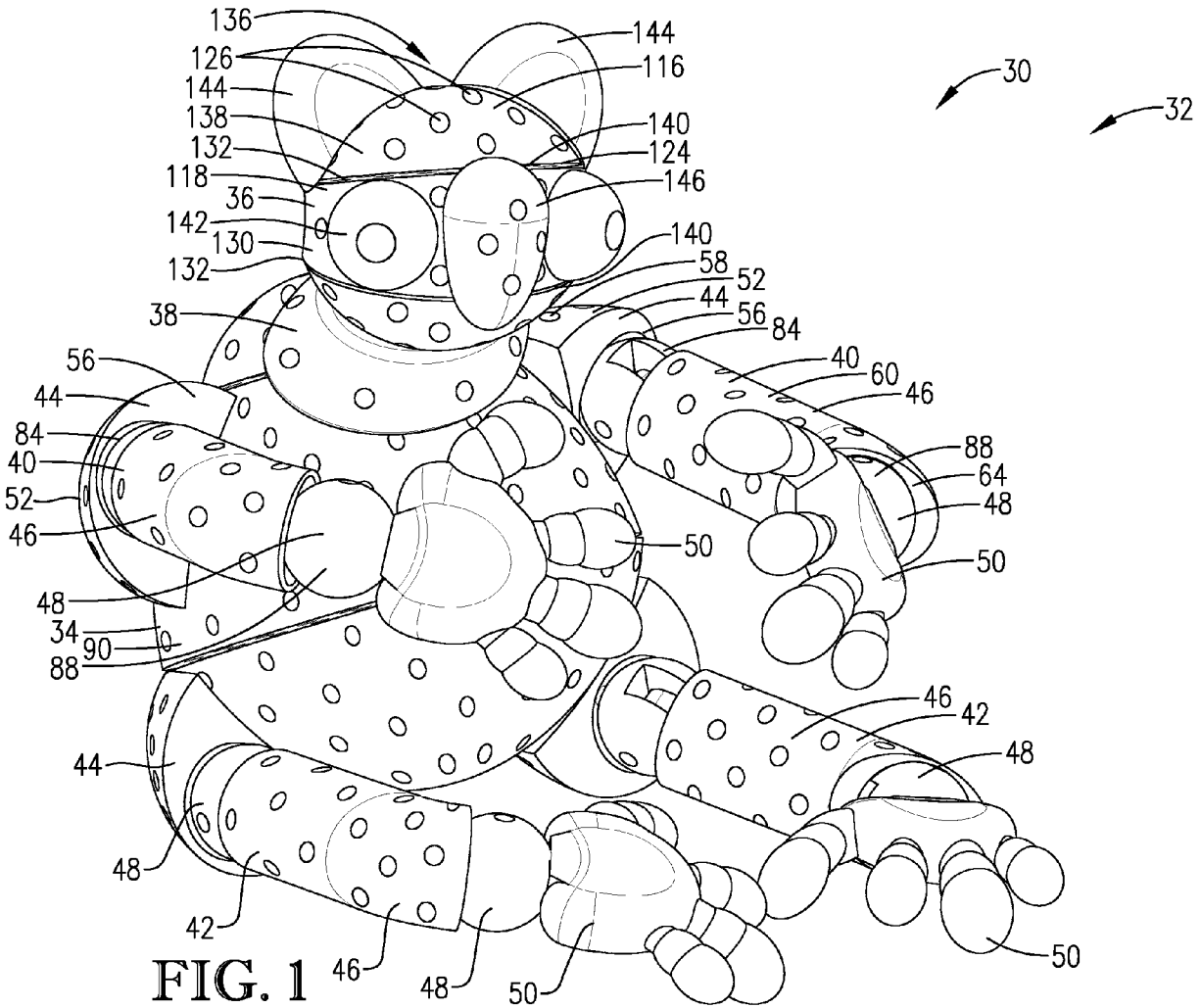
FIG. 1 is a front perspective of a toy creature constructed from parts of a modular construction toy kit in accordance with a first embodiment of the present invention, with the toy including a torso, arm assemblies, leg assemblies, a head, and a neck that connects the head to the torso.
Figure 3:
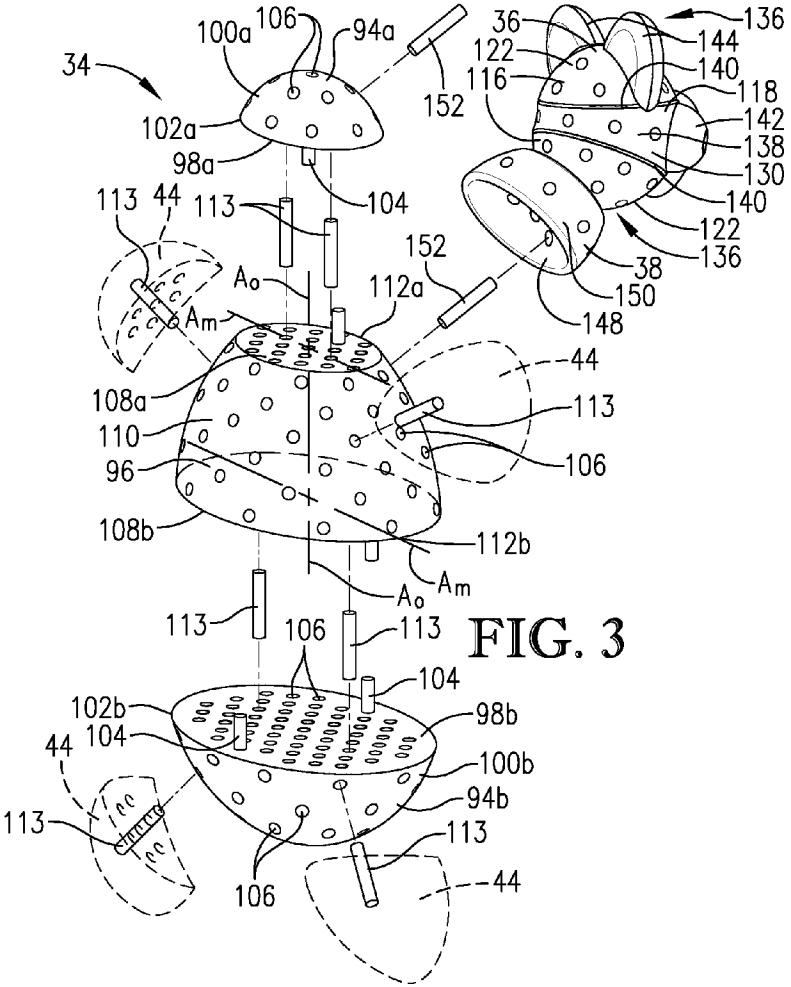
FIG. 3 is a fragmentary rear perspective of the modular construction toy shown in FIGS. 1 and 2, showing opposite end body sections and a transition body section of the torso being exploded from one another, and showing the head and neck exploded from the torso.
Figures 4A, 4B, 5:
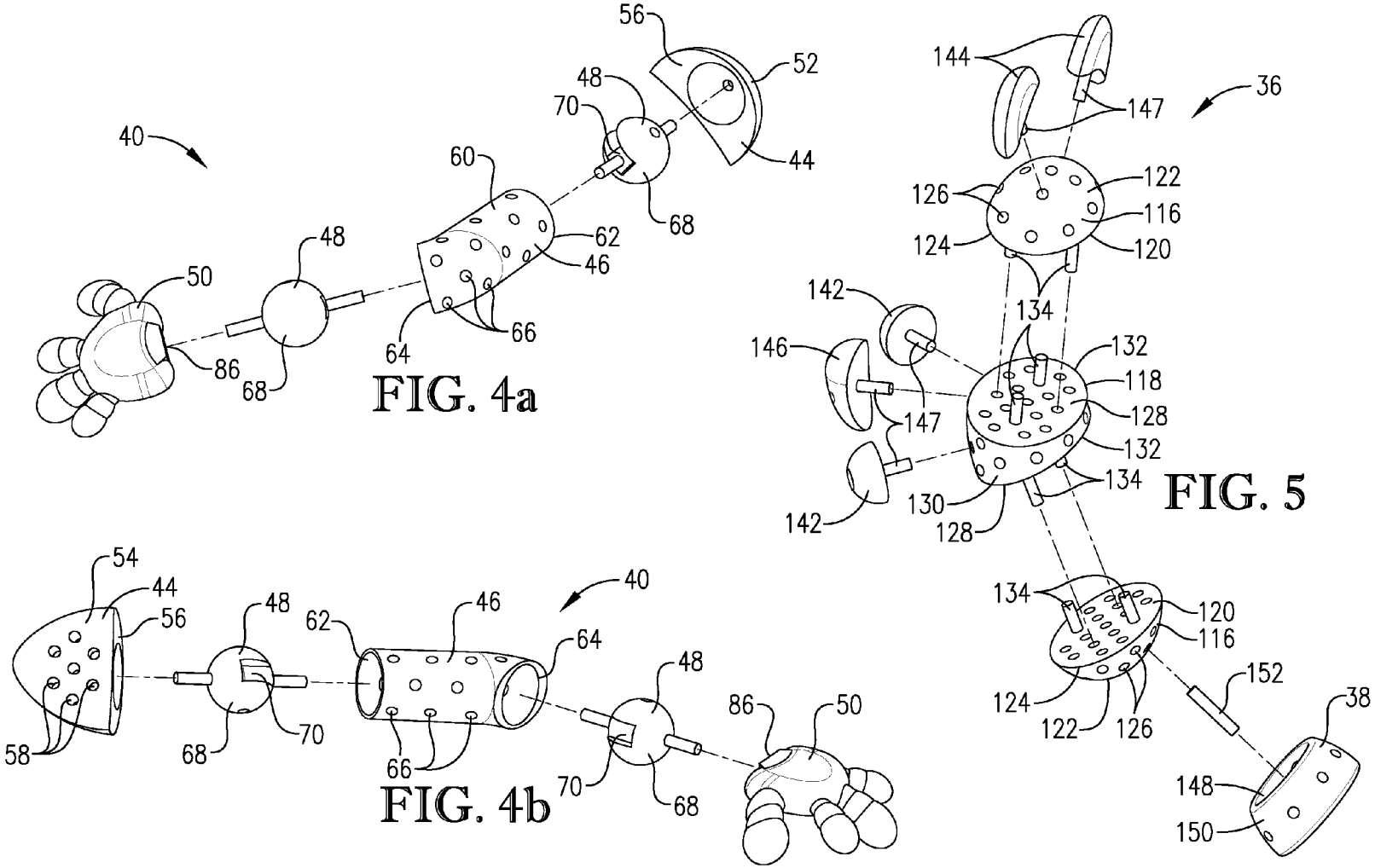
Figures 6, 7:
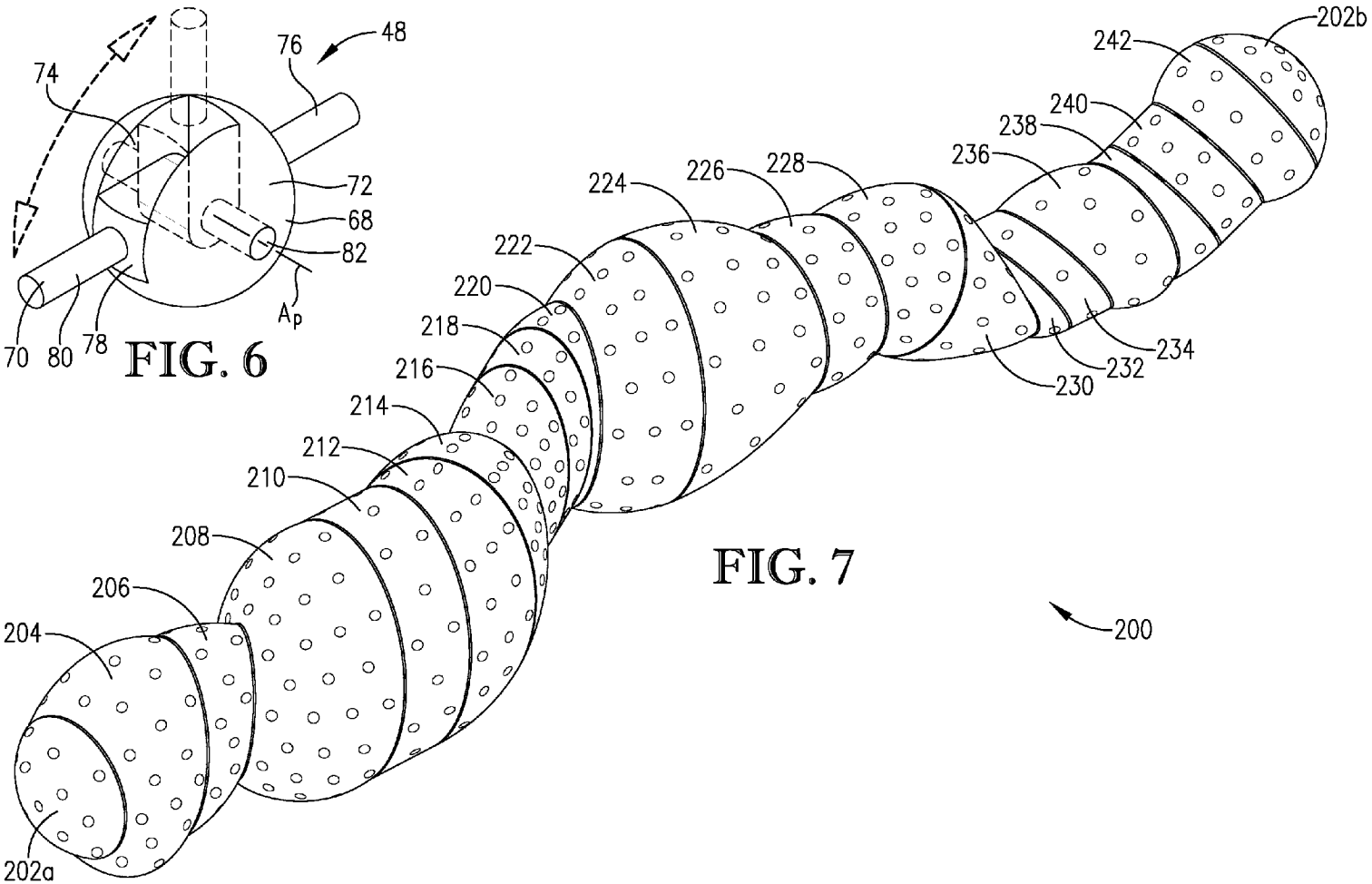
Figure 8:
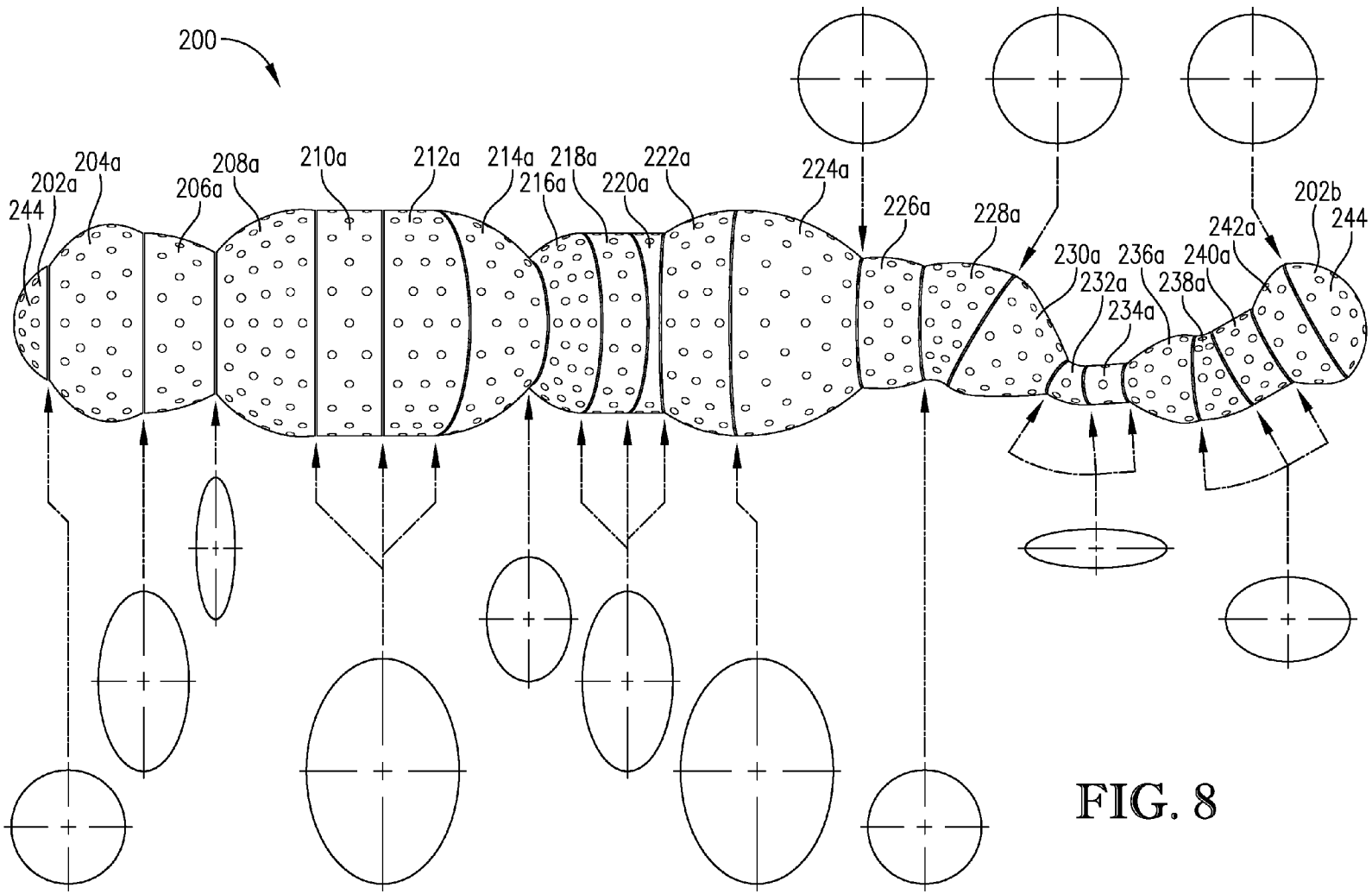
Figure 9:
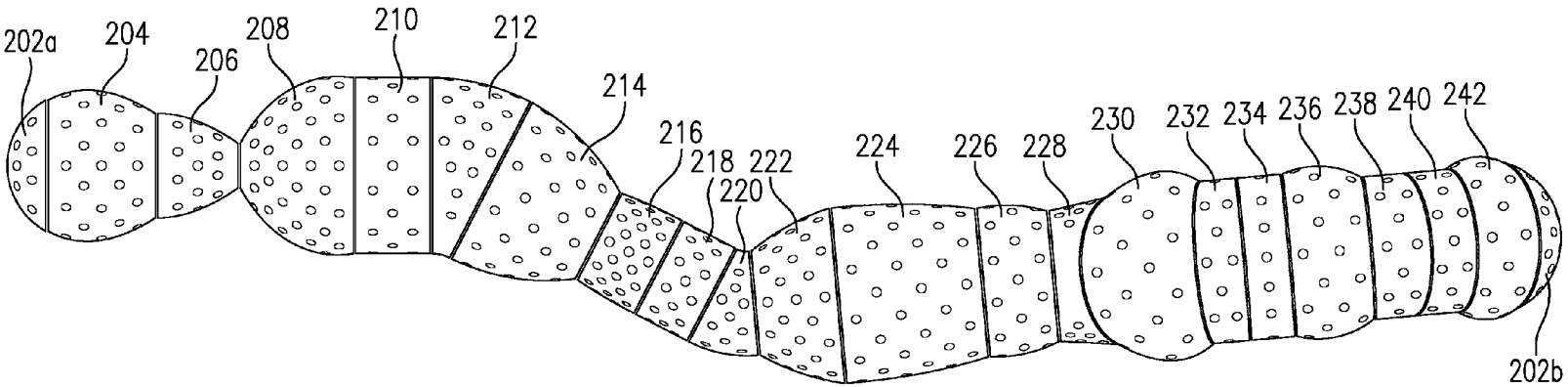
Figure 10:
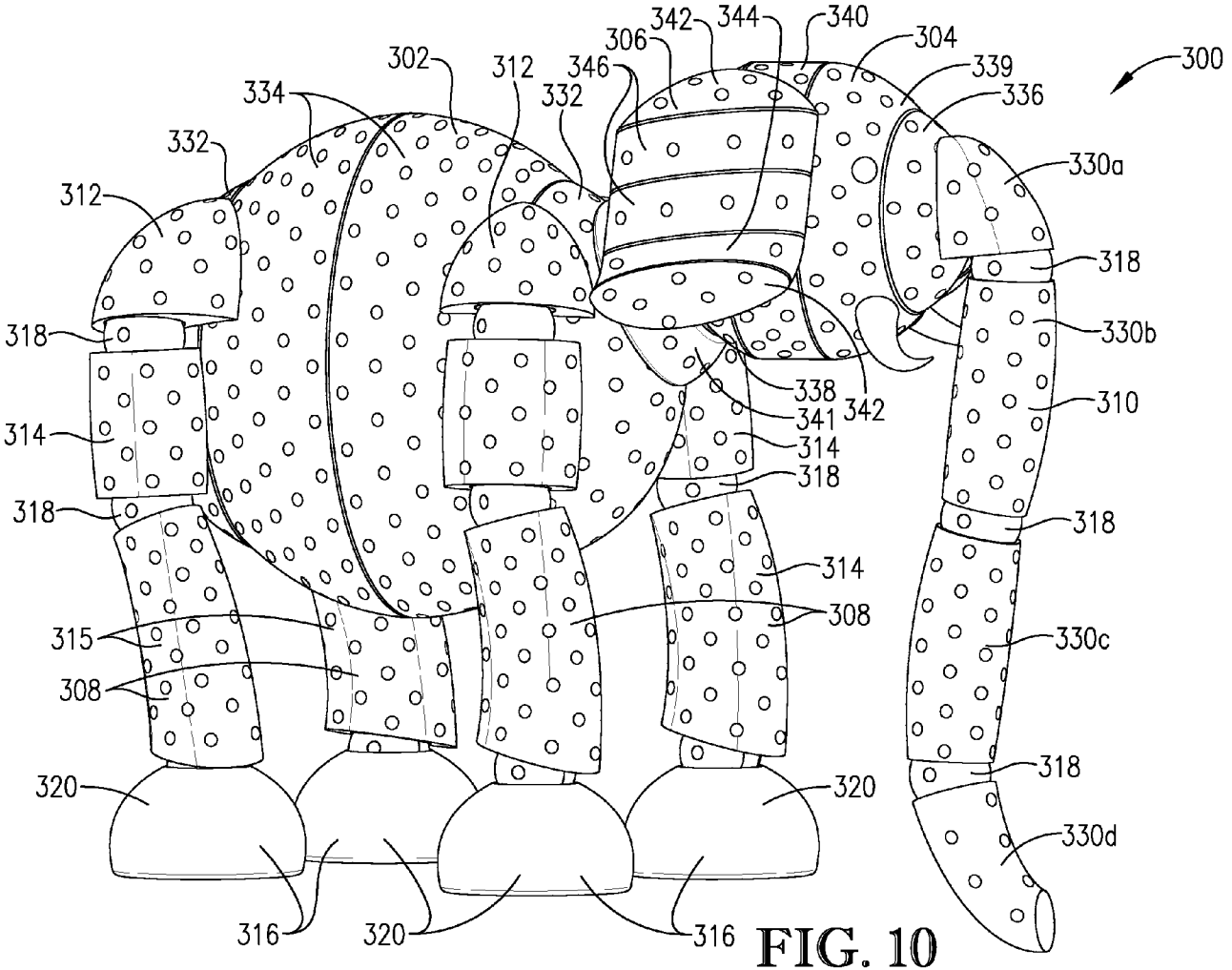
Figure 13:
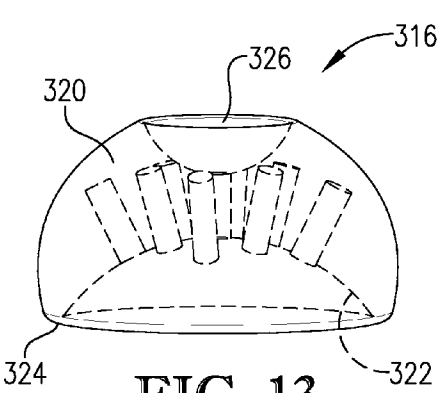
Figure 16:
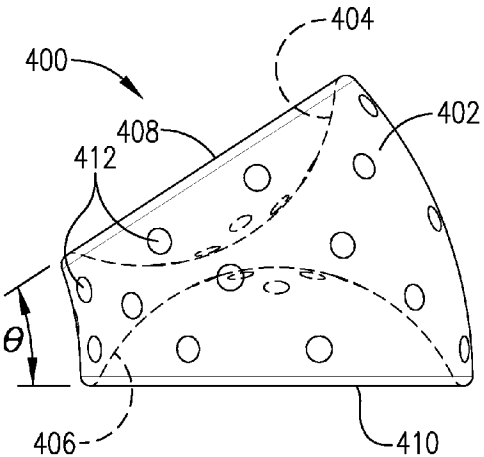
Figure 12:
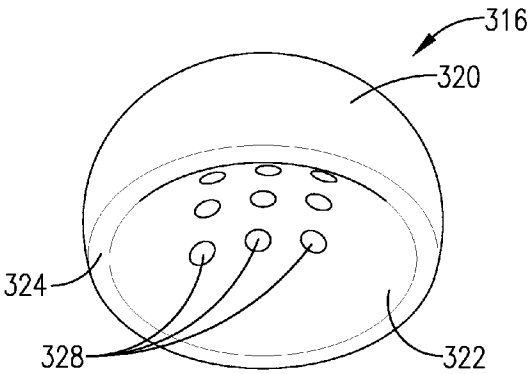
Figure 15:
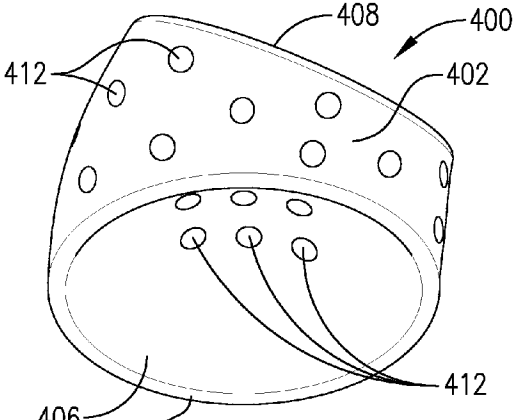
Figure 11:
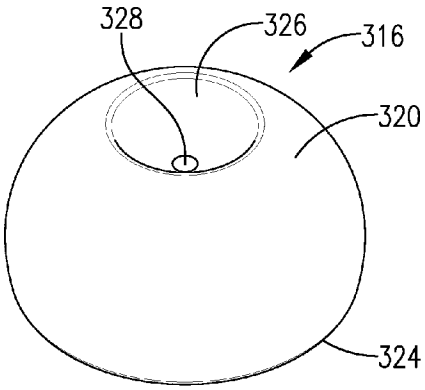
Figure 14:
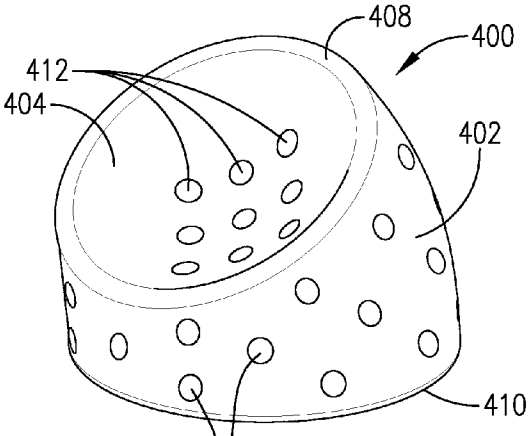
Figure 18:
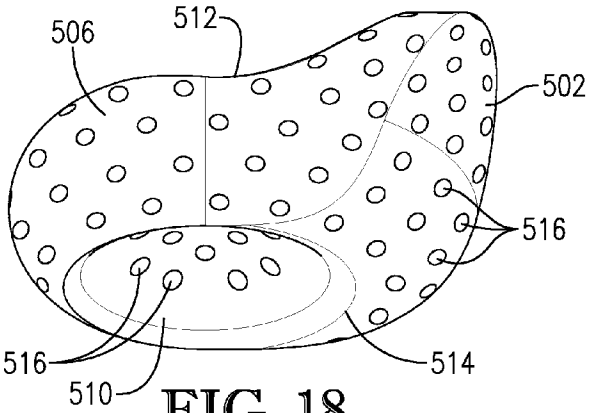
Figure 17:
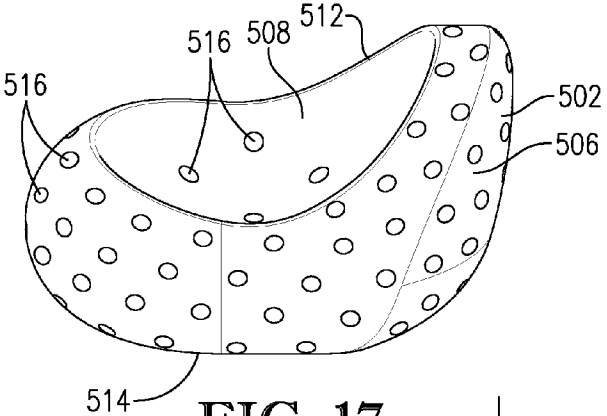
Figure 19:
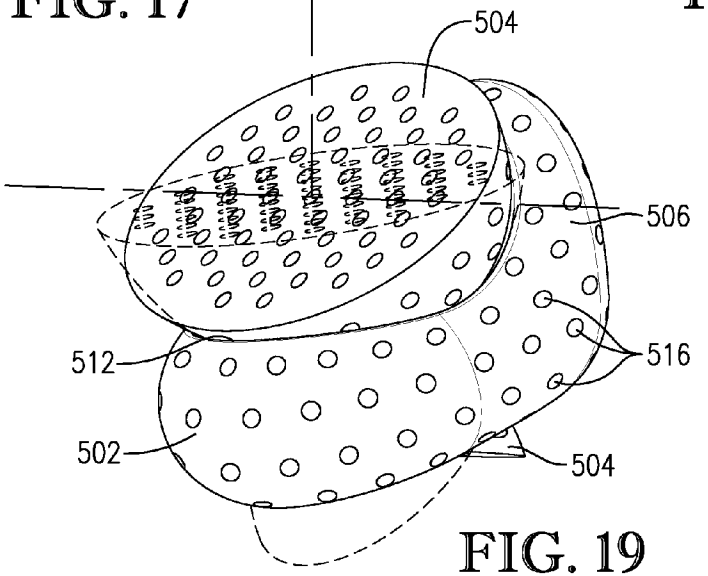
Figure 20:
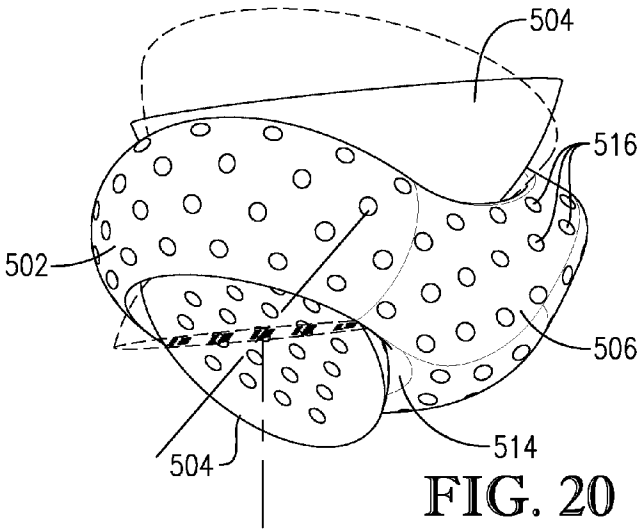
Figure 21:
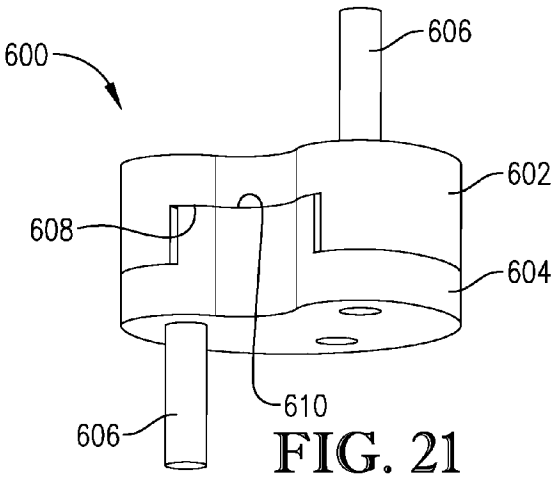
Figure 23:
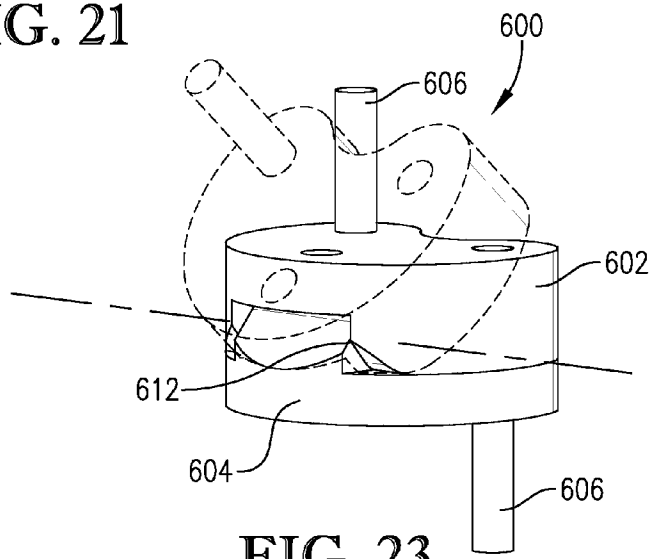
Figure 22:
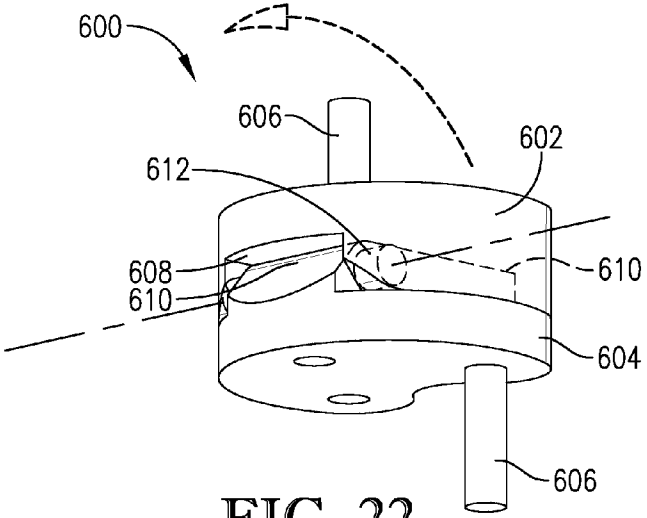

FIG. 4*a* is an exploded view of one of the arm assemblies shown in FIG. 1, with the arm assembly including a shoulder section, arm section, hand section, and a pair pivot connectors that pivotally interconnect the sections;

FIG. 4*b* is an exploded view of the arm assembly similar to FIG. 4*a*, but showing the arm assembly from an opposite side;

FIG. 5 is an exploded view of the head and neck shown in FIGS. 1 and 3, with the head including end body sections, a transition body section, extremity sections including eyes, ears, and a nose, and pegs to interconnect the body sections;

FIG. 6 is a pivot connector shown in FIGS. 1, 4*a*, and 4*b*, with the pivot connector including a ball-shaped housing and a pivotally mounted shank;

FIG. 7 is a perspective of a toy creature constructed from parts of a modular construction toy kit in accordance with a second embodiment of the present invention, with the toy including opposite end body sections and a plurality of transition body sections attached to one another in series;

FIG. 8 is a side elevation of the modular construction toy shown in FIG. 7, with the body sections presenting joining faces associated with connection interfaces between adjacent body sections, showing the marginal shape of the joining faces at each connection interface;

FIG. 9 is a top view of the modular construction toy shown in FIGS. 7 and 8;

FIG. 10 is a front perspective of a toy creature constructed from parts of a modular construction toy kit in accordance with a third embodiment of the present invention, with the toy including a torso, leg assemblies that each include a foot section, a head, a neck that connects the head to the torso, a toy body in the form of an ear attached to the head, and a trunk assembly attached to the head;

FIG. 11 is an upper perspective of the foot section shown in FIG. 10, showing a contoured outer surface that presents a socket and a bore that extends inwardly from the socket;

FIG. 12 is a lower perspective of the foot section shown in FIGS. 10 and 11, showing a concave face surface that intersects the contoured outer surface and bores that extend inwardly from the concave face surface;

FIG. 13 is a side elevation of the foot section shown in FIGS. 10-12;

FIG. 14 is an upper perspective of a body section provided as part of the modular construction toy kit, showing an upper concave face surface that intersects a contoured outer surface and bores that extend inwardly from the upper concave face and outer surfaces;

FIG. 15 is a lower perspective of the body section shown in FIG. 14, showing a lower concave face surface that intersects the contoured outer surface and bores that extend inwardly from the lower concave face and outer surfaces;

FIG. 16 is a side elevation of the body section shown in FIGS. 14 and 15, showing the faces cooperatively defining an acute angle therebetween;

FIG. 17 is an upper perspective of a contoured body section provided as part of the modular construction toy kit, showing an upper concave face surface that intersects a contoured outer surface and bores that extend inwardly from the upper concave face and outer surfaces;

FIG. 18 is a lower perspective of the contoured body section shown in FIG. 17, showing a lower concave face surface that intersects the contoured outer surface and bores that extend inwardly from the lower concave face and outer surfaces;

FIG. 19 is an upper perspective of the contoured body section shown in FIGS. 17 and 18 connected to additional body sections on opposite sides thereof, with the additional body sections each presenting a contoured surface and a generally planar face, and with alternative positions of the additional body sections being depicted by broken lines;

FIG. 20 is a lower perspective of the body sections shown in FIG. 19;

FIG. 21 is a lower perspective of a hinged connector body section provided as part of the modular construction toy kit, showing a pair of plates attached to each other with the plates each having a peg secured thereto;

FIG. 22 is a lower perspective of the hinged connector body section similar to FIG. 21 but taken from the opposite side, showing the plates connected to each other at a hinged joint; and FIG. 23 is an upper perspective of the hinged connector body section shown in FIGS. 21 and 22, showing the plates in a folded plate position, with an upper one of the plates also being shown in broken lines to depict the upper plate pivoted into an unfolded plate position.

The drawing figures do not limit the present invention to the specific embodiments disclosed and described herein. The drawings are not necessarily to scale, emphasis instead being placed upon clearly illustrating the principles of the preferred embodiment.

DETAILED DESCRIPTION OF THE PREFERRED EMBODIMENTS

Turning initially to FIG. 1, a modular construction toy 30 is constructed in accordance with a preferred embodiment of the present invention. The illustrated modular construction toy 30 is preferably constructed from a modular construction toy kit 32 that includes a plurality of unassembled construction pieces including those used to assemble the construction toy 30. However, it is also within the scope of the present invention where the toy kit 32 includes only the pieces that form the construction toy 30.

The components of the construction toy kit 32 are preferably used to form the illustrated construction toy 30, which generally has the form of a bear-like creature. However, it is also within the ambit of the present invention where the toy kit components are used to form other toy shapes, such as other animal creatures, etc.

The illustrated modular construction toy 30 broadly includes a torso 34, head 36, neck 38, arm assemblies 40, and leg assemblies 42. As will be discussed in greater detail, the toy 30 is preferably configured so that the torso 34 is selectively removably interconnected to the head 36 and neck 38, the arm assemblies 40, and the leg assemblies 42.

Turning to FIGS. 1-6, the arm assemblies 40 are preferably designed to be removably attached to the torso 34. At the same time, the arm assemblies 40 are each shiftable among multiple positions while attached to the torso 34. It may be desirable to provide such adjustable movement for various reasons, e.g., so that each arm assembly 40 can emulate arm positions associated with known animals. Each arm assembly 40 preferably includes a plurality of body sections in the form of a shoulder section 44, arm section 46, pivot connector section 48, and a hand section 50.

Each shoulder section 44 is preferably unitary and designed to resemble the shoulder of an animal. The illustrated shoulder section 44 includes a contoured shoulder outer surface 52 and shoulder faces 54,56. The face 54 comprises a curved face. The face 56 includes a generally concave socket. The shoulder section 44 also presents multiple inwardly extending bores 58 that are positioned along and extend inwardly from the shoulder outer surface 52 and faces 54,56.

Each arm section 46 is preferably unitary and includes a contoured arm outer surface 60 and proximal and distal arm end faces 62,64. Each end face 62,64 includes a generally concave socket. The arm section 46 also presents multiple inwardly extending bores 66 positioned along the arm outer surface 60 and a respective bore 66 extending inwardly from each socket of the end faces 62,64.

The illustrated pivot connector section 48 preferably includes a generally ball-shaped housing 68 and a pivotal shank 70 (see FIG. 6). The housing 68 presents a spherical outer surface 72 and a slot 74 that extends inwardly therefrom. The housing 68 also includes a peg 76 that projects outwardly from the spherical surface 72. The shank 70 includes a rectangular section 78 and a peg 80. The rectangular section 78 of the shank 70 is pivotally mounted within the slot 74 with a pin 82 so that the peg 80 projects outwardly relative to the slot 74. Thus, the pegs 76,80 are preferably pivotal relative to one another about a pin axis Ap. The pegs 76,80 are pivotal between a parallel position, where the pegs 76,80 are substantially coaxial, and a perpendicular position, where the pegs 76,80 are substantially perpendicular with each other (see FIG. 6).

The shoulder and arm sections 44,46 are preferably removably attached to each other with one of the pivot connector sections 48. In the illustrated embodiment, the ball-shaped housing 68 is inserted into the socket of the shoulder section 44, with the peg 76 being inserted into the corresponding bore of the socket. Also, when connected to each other, the housing 68 and shoulder section 44 are rotatable relative to one another about the axis of the peg 76, with the housing 68 and socket being complementally shaped to permit such rotating movement.

The housing 68 and shank 70 are inserted into the socket of the proximal end face 62 of the arm section 46, with the peg 80 being inserted into the corresponding bore. Also, when connected to each other, the housing 68 and arm section 46 are rotatable relative to one another about the axis of the peg 80, with the housing 68 and socket being complementally shaped to permit such rotating movement.

The shoulder and arm sections 44,46 and the pivot connector section 48 preferably cooperatively form a pivot joint 84. The pivot joint 84 permits relative pivotal movement between the shoulder and arm sections 44,46 about the pin axis Ap and about the axes of pegs 76,80. However, the shoulder and arm sections 44,46 could be alternatively connected to one another without departing from the scope of the present invention.

Each hand section 50 is preferably unitary and presents a concave socket 86 and a bore that extends inwardly from the socket 86. The arm and hand sections 46,50 are also preferably removably attached to each other with one of the pivot connector sections 48. In the illustrated embodiment, the ball-shaped housing 68 is inserted into the socket 86 of the hand section 50, with the peg 76 being inserted into the corresponding bore extending from the socket 86. Also, when connected to each other, the housing 68 and hand section 50 are rotatable relative to one another about the axis of the peg 76, with the housing 68 and socket 86 being complementally shaped to permit such rotating movement.

The housing 68 and shank 70 are inserted into the socket of the distal end face 64 of the arm section 46, with the peg 80 being inserted into the corresponding bore extending from the socket. Also, when connected to each other, the housing 68 and arm section 46 are rotatable relative to one another about the axis of the peg 80, with the housing 68 and socket being complementally shaped to permit such rotating movement.

The arm and hand sections 46,50 and the pivot connector section 48 preferably cooperatively form a pivot joint 88. The pivot joint 88 permits relative pivotal movement between the arm and hand sections 46,50 about the pin axis Ap and about the axes of pegs 76,80. However, the arm and hand sections 46,50 could be alternatively connected to one another without departing from the scope of the present invention.

The illustrated leg assemblies 42 are also preferably designed to be removably attached to the torso 34. At the same time, the leg assemblies 42 are each shiftable among multiple positions while attached to the torso 34. It may be desirable to provide such adjustable movement for various reasons, e.g., so that each leg assembly 42 can emulate leg positions associated with known animals.

Each leg assembly 42 preferably has substantially the same components as the arm assemblies 40. Thus, each leg assembly 42 preferably includes a shoulder section 44, arm section 46, pivot connector sections 48, and a hand section 50. However, the principles of the present invention are applicable where the leg assemblies 42 have an alternative configuration.

The illustrated components of the arm and leg assemblies 40,42 preferably comprise appendage body sections. In particular, the appendage body sections are each preferably devoid of a joining face, as will be described with respect to the components forming the torso 34 and head 36. It is particularly noted that the appendage body section do not have a face that cooperates with the face of another body section to define the connection interface associated with the torso 34 and head 36.

As mentioned above, the illustrated torso 34 is selectively removably attached to the head 36, neck 38, arm assemblies 40, and leg assemblies 42. The torso 34 preferably has a construction that presents a curved or contoured outer surface 90 that extends continuously (except for the peg openings described below) between ends 92 of the torso 34 (see FIG. 2). The illustrated torso 34 preferably includes three body sections in the form of opposite end body sections 94*a,b* and an intermediate transition body section 96. However, as will be shown in subsequent embodiments, the torso 34 could include an alternative number and/or configuration of body sections. For instance, the torso 34 could have more than one intermediate transition body section. Also, a toy body could have more than two end body sections that are interconnected by one or more transition body sections that branch out in more than two opposite directions.

The end body section 94*a* is preferably unitary and presents an end joining face 98*a* and an opposite curved contoured outer end surface 100*a*. The end body section 94*a* is preferably truncated where the end joining face 98*a* intersects the outer end surface 100*a* along a margin 102*a*. The end body section 94*a* also preferably includes a fixed peg 104 that projects outwardly from the end joining face 98*a* and serves as a connector to removably interconnect the end body section 94*a* to transition body section 96. However, it will be appreciated that an alternative connection structure (e.g., a removable peg, magnetic connector, etc.) could be used without departing from the scope of the present invention.

The outer end surface 100*a* preferably projects continuously from the margin 102*a* of the end joining face 98*a*. The end body section 94*a* further presents a plurality of bores 106 positioned along and extending inwardly from the end joining face 98*a* and outer end surface 100*a*.

Similarly, the end body section 94*b* is preferably unitary and presents an end joining face 98*b* and a curved or contoured outer end surface 100*b*. The end body section 94*b* also includes fixed pegs 104 that project outwardly from the end joining face 98*b*. The end body section 94*b* is preferably truncated where the end joining face 98*b* intersects the outer end surface 100*b* along a margin 102*b*.

The outer end surface 100*b* also preferably projects continuously from the margin 102*b* of the end joining face 98*b*. The end body section 94*b* further presents a plurality of bores 106 positioned along and extending inwardly from the end joining face 98*b* and outer end surface 100*b*.

The illustrated margins 102*a,b*, which form the perimeter and outer shape of the respective end joining faces 98*a,b*, preferably present generally elliptical shapes. However, the margins 102*a,b* preferably do not match one another in size nor shape. In alternative forms, the margins 102*a*,102*b* could have the same shape but be proportionately different in size, or the margins 102*a*,102*b* could have a similar size (e.g., in area) but be different shapes. It is only important that the contoured transition body section 96 having differently shaped and/or sized joining faces is provided. In fact, according to some aspects of the present invention, the joining faces of certain end body sections could marginally match one another when constructing certain toys (such end caps with marginally matching joining faces could have dissimilar outer surfaces). It is only necessary for the kit to also have at least one other end body section with a non-matching joining face and a transition body section(s) that permit smooth interconnection of the non-matching end body sections. That is, it is critical that the kit have transition body section(s) that make it able to smoothly and continuously interconnect non-matching end body sections.

Again, the shapes of the illustrated margins 102*a,b* are preferably different. Furthermore, the margin 102*a* is smaller than margin 102*b*. However, it is also within the ambit of the present invention where the margins 102*a,b* have totally different geometric shapes, e.g., where one shape is an ellipse and the other shape is a circle.

The end body sections 94*a,b* preferably have a generally ellipsoidal cap shape. That is, the end body sections 94*a,b* each have the shape of an endmost section of an ellipsoid (i.e., a frusto-ellipsoidal shape). However, the end body sections 94*a,b* could have an alternative shape without departing from the scope of the present invention. For instance, the end body sections 94*a,b* could have an alternative ellipsoidal cap shape, such as a spherical cap that comprises an endmost section of a sphere (i.e., a frusto-spherical shape) or a spheroidal cap that comprises an endmost section of a spheroid (i.e., a frusto-spheroidal shape), or some other shape. Furthermore, the end body sections 94*a,b* could include other contoured surface shapes, such as a concave surface, as part of the outer end surface 100*a,b*. Yet further, the outer end surface 100*a,b* could include a combination of surface shapes such as multiple convex and/or concave surfaces. Also, the illustrated end joining faces 98*a,b* are preferably substantially planar. However, the end joining faces 98*a,b* could alternatively be convex, concave, or a combination of surface shapes such as multiple convex and/or concave surfaces.

The transition body section 96 preferably provides a smooth shaped transition between the end body sections 94, as will be discussed. The transition body section 96 is preferably unitary and presents opposite transition joining faces 108*a,b* and a contoured outer transition surface 110. The joining faces 108*a,b* preferably intersect the outer transition surface 110 along corresponding margins 112*a,b* so that the outer transition surface 110 extends continuously (except for peg bores as will be described) from one joining face 108*a* to the other joining face 108*b*. The transition body section 96 further presents a plurality of bores 106 positioned along and extending inwardly from the joining faces 108*a,b* and outer transition surface 110. The transition body section 96 also preferably presents fixed pegs 104 that project from the transition joining faces 108.

The illustrated margins 112*a,b*, which form the outer shape of transition joining faces 108*a,b*, preferably present generally elliptical shapes that each define a major axis Am (see FIG. 3). Again, as will be shown in subsequent embodiments, the margins 112*a,b* could present alternative geometrical shapes, such as circles or other types of ovals.

The transition joining faces 108*a,b* are preferably substantially planar. However, the principles of the present invention are applicable where the transition joining faces 108*a,b* are alternatively convex, concave, or a combination of surface shapes such as multiple convex and/or concave surfaces. The illustrated transition joining faces 108*a,b* are also preferably substantially parallel to one another. However, the transition joining faces 108*a,b* could be arranged to define a non-zero angle therebetween.

The transition joining faces 108*a,b* are preferably positioned so that the major axes Am of the elliptical margins 112 are substantially parallel to one another (see FIG. 3). However, it is also within the ambit of the present invention where the major axes Am are rotated relative to one another about the longitudinal axis of the transition body section 96.

The transition joining faces 108*a,b* are preferably arranged so that the margins 112*a,b* define orthogonal axes Ao that are substantially coaxial. That is, each margin 112*a,b* presents an axis Ao orthogonal to the plane defined by the margin 112 and the axes Ao are substantially coaxial (see FIG. 3). However, for some aspects of the present invention, the joining faces 108*a,b* could be positioned so that the orthogonal axes Ao are offset from or angled relative to one another.

The transition body section 96 preferably has a generally ellipsoidal segment shape. That is, the transition body section 96 has the shape of an ellipsoid with both ends truncated. However, the transition body section 96 could have an alternative shape without departing from the scope of the present invention. For instance, the transition body section 96 could have an alternative ellipsoidal segment shape, such as a spherical segment (a sphere with opposite ends removed) or a spheroidal segment (a spheroid with ends removed), or some other shape. Furthermore, the transition body section 96 could include other contoured shapes, such as a concave surface, to present the outer transition surface 110. Yet further, the outer transition surface 110 could include a combination of surface shapes such as multiple convex and/or concave surfaces.

The end body sections 94 and transition body section 96 are joined in series with one another to cooperatively form the continuous torso 34. The illustrated torso 34 presents opposite ends 92 and the exposed contoured outer body surface 90 that extends continuously (except for the bores 106) between the ends 92. Thus, as will be explained, the transition body section 96 preferably provides a smooth shaped transition between the end body sections 94.

The end body sections 94 and transition body section 96 are preferably removably interconnected in series by fixed pegs 104 and by removable pegs 113 that extend into and frictionally engage the respective body section along one of the bores 106. While a combination of pegs 104,113 are preferably used to interconnect body sections 94,96, for some aspects of the present invention, the body sections 94,96 could be interconnected only by fixed pegs 104 or by removable pegs 113. Also, a single peg 104 or 113 or alternative number of pegs 104,113 could be used to interconnect the body sections 94,96.

Preferably, the pegs 104,113 each present a generally cylindrical surface that frictionally engages the body along the generally cylindrical bore. However, it is within the scope of the present invention where the pegs and/or bore-defining structure have other features to provide a removable mechanical and/or frictional interfitting, such complemental notches, detents, bumps, etc. Furthermore, it is within the ambit of the present invention where an alternative type of connector (e.g., magnetic connectors) is used to removably interconnect the body sections 94,96. The illustrated construction toy 30 also preferably includes additional removable pegs 113, e.g., for attaching the arm and leg assemblies 40,42 to the torso 34.

Figure 2:
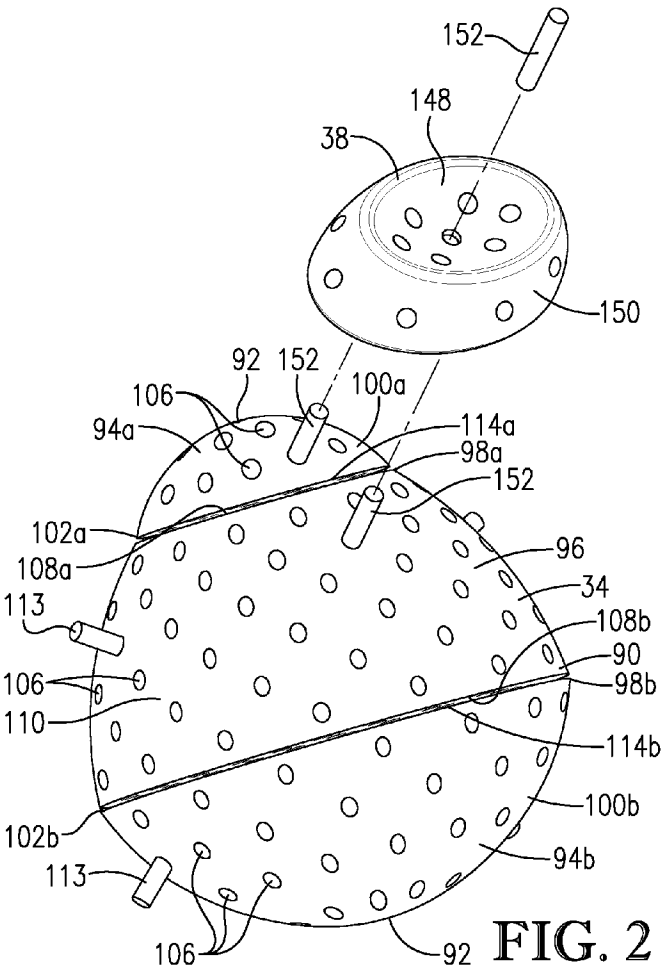
FIG. 2 is a fragmentary front perspective of the modular construction toy shown in FIG. 1, showing the neck and one of multiple peg connectors as being exploded from the torso, with other peg connectors being inserted into corresponding bores presented by the torso.

Respective pairs ofjoining faces 98,108 are preferably removably associated with one another to define connection interfaces 114*a,b* of the toy body (see FIG. 2). More preferably, the joined (or adjacent) joining faces 98,108 are in flush engagement with one another. Furthermore, the engaged pairs of joining faces 98,108 are preferably planar so as to be selectively rotatably positioned relative to one another. For instance, each pair of body sections 94,96 can be selectively positioned in one of two positions where the corresponding engaged joining faces are substantially coterminous. However, it is within the scope of the present invention where the joining faces 98,108 include locating features that require the associated body sections 94,96 to be located relative to one another in a predetermined position. Furthermore, if the joining faces alternatively have a circular marginal shape (or other repeatable shape), the respective body sections could be repositioned to numerous (e.g., more than two) alternative positions, depending on alignment of the peg-receiving bores. As previously noted, adjacent joining faces could have alternative shapes. For example, one of the faces could be concave and the other convex so as to maintain the preferred flush engagement. Alternatively (although less desirably), the joining faces could be slightly spaced apart, with one of the faces being smooth and the other being corrugated. It is only important that the adjacent joining faces substantially marginally match one another (i.e., the margins are substantially coterminous) so that a smooth transition from one body section to the other is provided at the connection interface. That is, the contoured outer surface 90 extends smoothly and substantially continuously across the connection interfaces 114 and between the body ends 92.

The illustrated construction permits dissimilarly shaped curved outer surfaces to be joined along a respective connection interface 114 while still providing a smooth and substantially continuous surface across the connection interface 114. More preferably, at each connection interface 114, there is no radially projecting component (or shoulder) of either body section. Although the outer body surface 92 may even change direction at the connection interface, it is a smooth, curved change rather than a sharp or orthogonal transition. Again, it may be said that each body section 94,96 is preferably substantially shoulderless at each corresponding connection interface 114. This is attributable to the fact that the body sections present continuous, curved outer surfaces and the joining faces are coterminous.

Although, the illustrated outer end surfaces 100 and outer transition surfaces 110 do not share a common line of tangency at the connection interfaces 114, the surfaces 100,110 cooperatively provide a smooth, contoured outer surface for the construction toy. As will be shown subsequently, it is also within the ambit of the present invention where surfaces of connected body sections share a common line of tangency at a connection interface.

Turning to FIGS. 1, 3, and 5, the head 36 includes three body sections in the form of opposite end body sections 116 and an intermediate transition body section 118 to form a continuous toy body.

The end body sections 116 are preferably substantially identical. Similar to the previously described end body sections 94, each end body section 116 is preferably unitary and presents an end joining face 120 and a contoured outer end surface 122. The end joining face 120 preferably intersects the outer end surface 122 along a margin 124. The outer end surface 122 also preferably projects continuously from the margin 124 of the joining face 120. The end body section 116 further presents a plurality of bores 126 positioned along and extending inwardly from the end joining face 120 and outer end surface 122.

The illustrated margins 124 preferably present generally elliptical shapes, but could define alternative geometrical shapes, as discussed above. The end body sections 116 also preferably have a generally ellipsoidal cap shape, but could have alternative shapes, as discussed above.

The transition body section 118 is preferably unitary and presents opposite transition joining faces 128 and a contoured outer transition surface 130. The joining faces 128 preferably intersect the outer transition surface 130 along corresponding margins 132 so that the outer transition surface 130 extends continuously from one joining face 128 to the other joining face 128.

The margins 132 preferably present generally elliptical shapes. Preferably, the elliptical shapes of the joining faces 120,128 are substantially identical to one another.

The illustrated transition joining faces 128 preferably cooperatively define an oblique angle therebetween. That is, the joining faces 128 are in a nonparallel orientation relative to each other. Thus, the transition body section 118 presents a contoured form that is generally concavo-convex.

The end body sections 116 and transition body section 118 are preferably joined in series with one another. The end body sections 116 and transition body section 118 are preferably removably interconnected by removable pegs 134 (see FIG. 5). The body sections 116,118 cooperatively form the continuous head 16 with opposite ends 136 and an exposed contoured outer surface 138 that extends continuously between the ends 136.

Respective pairs of joining faces 120,128 are preferably removably joined to one another to define connection interfaces 140 of the head 16. More preferably, the adjacent pairs of joining faces 120,128 are in flush engagement with one another.

For each connection interface 140, the corresponding joining faces 120,128 are preferably substantially coterminous with one another. As a result, the contoured outer surface 138 extends smoothly and continuously across the connection interfaces 140 and between the body ends 136. Again, this construction also permits dissimilar curved outer surfaces to be joined in a smooth and continuous fashion along a connection interface. More preferably, at each connection interface 140, there is no radially projecting component of either body section so that each connection interface 140 is substantially shoulderless.

The head 36 further includes various appendage body sections including eye sections 142, ear sections 144, and nose section 146. Each of the eye sections 142, ear sections 144, and nose section 146 is preferably unitary and includes a single peg for attachment to other body sections of the construction toy 30, such as the sections forming the head 36. As before, the appendage body sections are each preferably devoid of any joining face that cooperates to define one of the connection interfaces 114,140.

The neck 38 preferably comprises a unitary body section that presents contoured end faces 148 that intersect a contoured outer surface 150 so that the outer surface 150 extends between the end faces 148. The neck 38 is preferably removably attached to the torso 34 with removable pegs 152. Also, the head 36 is preferably removably attached to the neck 38 with removable pegs 152.

In use, components of the toy kit 32 can be selectively assembled to form the modular construction toy 30. The user can assemble the components of the construction toy 30 in different sequences. As one example, the user could first assemble the torso 34, then assemble and attach the leg assemblies 42 to the torso, then the arm assemblies 40, etc. Furthermore, the components of the toy kit 32 could be assembled to form alternative toys.

Likewise, the illustrated construction toy 30 can be selectively adjusted to change the shape of the toy 30. For instance, one or more of the arm assemblies 40, leg assemblies 42, the head 34, and neck 36 can be shifted, e.g., so that the toy 30 assumes a different posture or expression.

Furthermore, the construction toy 30 is preferably constructed so as to be partly or entirely disassembled. For instance, the toy 30 could be entirely disassembled to permit storage of the toy kit 32.

The kit 32 can additionally or alternatively be provided with other body sections to permit construction of other toy embodiments. Some of these embodiments and other body sections are depicted in FIGS. 7-23. For the sake of brevity, the remaining description will focus primarily on the differences of these alternative embodiments and components from the embodiment and components described above.

Initially turning to FIGS. 7-9, an alternative modular construction toy 200 is constructed in accordance with a second embodiment of the present invention. The construction toy 200 includes alternative contoured end body sections 202*a,b* and alternative intermediate transition body sections 204, 206,208,210,212,214,216,218,220,222,224, 226,228,230,232,234,236,238,240,242 (see FIG. 7).

The illustrated end body sections 202 each present an end joining face and an outer end surface 244. The end body sections 202 are each preferably truncated spheroid cap segments. The transition body sections 204 each present opposite transition joining faces and a contoured outer transition surface 204*a*-242*a* that extends between corresponding transition joining faces (see FIG. 8).

Preferably, adjacent pairs of joining faces are positioned in flush engagement with one another and are joined to define connection interfaces of the toy body. For each connection interface, the corresponding joining faces are preferably substantially coterminous with one another so that the contoured outer surface extends continuously across the connection interface. The matching marginal shapes of the joining faces associated with each connection interface are depicted in FIG. 8.

Turning to FIGS. 10-13, an alternative modular construction toy 300 is constructed in accordance with a third embodiment of the present invention. The construction toy 300 includes alternative toy bodies in the form of an alternative torso 302, alternative head 304, and alternative ear 306. The construction toy 300 also includes leg assemblies 308 that are removably attached to the torso 302 and a trunk assembly 310 removably attached to the head 304.

The leg assemblies 308 have substantially identical components. Each leg assembly preferably includes a shoulder section 312, elongated leg sections 314,315, a foot section 316, and pivot connector sections 318 that interconnect the other sections.

Each foot section 316 presents a contoured outer surface 320 and a generally concave face 322 that intersects the outer surface along an outer margin 324 (see FIGS. 11-13). The contoured outer surface 320 presents a socket 326 and a bore 328 that extends inwardly from the socket 326. The foot section 316 presents a plurality of bores 328 that extend inwardly from the concave face 322.

The trunk assembly 310 includes trunk sections 330*a*, 330*b*,330*c*,330*d* interconnected by pivot connector sections 318.

The torso 302 preferably includes end body sections 332 and a pair of intermediate transition body sections 334 that are removably interconnected with one another in series.

The head 304 preferably includes end body sections 336, 338 and two intermediate transition body sections 339,340. The transition body section 340 preferably has a cross-sectional profile that is substantially constant from one transition joining face to the other transition joining face. The head 304 and torso 302 are preferably interconnected by a neck section 341.

The ear 306 preferably includes end body sections 342 and three intermediate transition body sections 344,346. Each of the transition body sections 346 preferably has a cross-sectional profile that is substantially constant from one transition joining face to the other transition joining face.

FIGS. 14-16 depict an additional body section 400. The body section 400 presents a contoured outer surface 402 and upper and lower concave faces 404,406 that intersect the contoured outer surface 402 along respective margins 408, 410. The body section 400 further presents a plurality of bores 412 that extend inwardly from the outer surface 402 and concave faces 404,406.

The illustrated faces 404,406 are preferably positioned to cooperatively define an acute face angle θ therebetween. The margins 408,410 associated with each face define respective planes, with the planes cooperatively defining the face angle θ (see FIG. 16).

While shown separate from other components of the construction toy kit, the body section 400 can serve as a transition body section between two adjacent body sections.

FIGS. 17-20 depict an additional contoured body section 502 and opposite end body sections 504 removably attached to one another. The contoured body section 502 presents a contoured outer body surface 506 and upper and lower concave faces 508,510. The upper and lower concave faces 508, 510 intersect the contoured outer body surface 506 along respective margins 512,514. The contoured body section 502 further presents a plurality of bores 516 that extend inwardly from the concave faces 508,510 and the outer body surface 506.

As depicted by broken lines, the end body sections 504 can be adjustably positioned and attached relative to the contoured body section 502.

Turning to FIGS. 21-23, an alternative connector section 600 is depicted. The connector section 600 preferably includes a pair of plates 602,604 attached to each other. The plates 602,604 each include a peg 606. Plate 602 presents an inner face with a groove 608. Plate 604 presents an inner face with a rib 610 that is complementally shaped with the groove 608.

The plates 602,604 are preferably pivotally connected to each other at a hinged joint 612. The plates 602,604 are pivotal between a folded plate position, where the inner faces engage one another (see the solid line depiction in FIG. 23), and an unfolded plate position, where the inner faces are spaced apart (see the broken line depiction in FIG. 23).

The preferred forms of the invention described above are to be used as illustration only, and should not be utilized in a limiting sense in interpreting the scope of the present invention. Obvious modifications to the exemplary embodiments, as hereinabove set forth, could be readily made by those skilled in the art without departing from the spirit of the present invention.

The inventor hereby states his intent to rely on the Doctrine of Equivalents to determine and assess the reasonably fair scope of the present invention as pertains to any apparatus not materially departing from but outside the literal scope of the invention as set forth in the following claims.

What is claimed is:

1. A modular construction toy kit comprising:

at least three contoured body sections operable to be interconnected in series with one another to cooperatively form a continuous toy body, wherein the body has opposite body ends and an exposed contoured outer body surface that extends substantially continuously between the ends, said body sections including at least one transition body section and a pair of end body sections, each of said end body sections being truncated so as to present a contoured outer end surface that is intersected by an end joining face, with the outer end surface being operable to define part of the body surface at one of the body ends, said end joining faces of the end body sections having different marginal shapes and/or sizes, said at least one transition section presenting a contoured outer transition surface operable to define part of the body surface between the body ends, said at least one transition section including opposite, endmost transition joining faces that intersect the outer transition surface, each endmost transition joining face marginally matching in shape and size a respective one of the end joining faces to define a connection interface, such that the transition joining faces are different from one another in marginal shape and/or size, said joining faces associated with each connection interface being substantially coterminous so that the body surface extends substantially continuously across the connection interfaces and the outer transition surface provides a smooth transition from one of the connection interfaces to the other one of the connection interfaces when the body sections are interconnected.

2. The modular construction toy kit as claimed in claim 1, each outer end surface presenting a substantially frusto-spherical shape.

3. The modular construction toy kit as claimed in claim 1, said joining faces of each connection interface being in flush engagement with one another when the corresponding body sections are interconnected.

4. The modular construction toy kit as claimed in claim 3, said joining faces being substantially planar.

5. The modular construction toy kit as claimed in claim 1; and a plurality of connectors operable to releasably interconnect the body sections.

6. The modular construction toy kit as claimed in claim 5, each of said connectors corresponding with a respective connection interface, each of said connectors comprising a peg associated with one of the body sections of the respective connection interface, with the other body section of the respective connection interface including a bore removably receiving the peg when the body sections are interconnected.

7. The modular construction toy kit as claimed in claim 6, said peg projecting outwardly from the joining face of the one body section, said bore extending inwardly from the joining face of the other body section.

8. The modular construction toy kit as claimed in claim 7, said one body section including an inwardly extending bore that removably receives the peg, such that the peg is removable from both body sections of the respective connection interface.

9. The modular construction toy kit as claimed in claim 8, said bores being axially aligned when the body sections of the respective connection interface are interconnected, said peg including axially aligned portions that are receivable in the bores when the body sections of the respective connective interface are interconnected.

10. The modular construction toy kit as claimed in claim 8, each of said body sections of the respective connection interface including a plurality of said bores, with each bore of the one body section aligning with a corresponding bore of other body section when the body sections are interconnected.

11. The modular construction toy kit as claimed in claim 1, said body sections including more than two of the end body sections, with the end body sections being variously sized and shaped.

12. The modular construction toy kit as claimed in claim 1, said endmost transition joining faces defining an oblique angle therebetween.

13. The modular construction toy kit as claimed in claim 1, said body sections including multiple transition body sections, each of which is provided with the opposite transition joining faces, said transition body sections being variously sized and shaped.

14. The modular construction toy kit as claimed in claim 13, at least one pair of said transition body sections including substantially coterminous transition joining faces so as to define one of the connection interfaces when the at least one pair of transition body sections are interconnected.

15. The modular construction toy kit as claimed in claim 1, each of said body sections having a plurality of inwardly extending bores spaced about the outer surface thereof; and a peg removably receivable in each of the bores so that a first body section is connectable to a second body section along the outer surface of the second body section.

16. The modular construction toy kit as claimed in claim 15, said body sections including a plurality of section sets, each of which includes a respective pair of the end sections and at least one transition section such that each set is operable to define a separate toy body, said separate toy bodies being connectable along the outer surfaces thereof.

17. The modular construction toy kit as claimed in claim 1, said body sections including an appendage body section that is devoid of one of the joining faces, said appendage body section being connectable to one of the other body sections.

18. The modular construction toy kit as claimed in claim 17, at least one of said body sections having a bore extending inwardly from the outer surface thereof; and a peg associated with the appendage body section, said peg being receivable in the bore so that the appendage body section is connectable to the at least one body section along the outer surface thereof.

19. The modular construction toy kit as claimed in claim 1, said outer transition surface projecting from at least one of the endmost transition joining faces at an oblique angle.

20. A modular construction toy comprising:

at least three contoured body sections removably interconnected in series with one another to cooperatively form a continuous toy body, wherein the body has opposite body ends and an exposed contoured outer body surface that extends substantially continuously between the ends, said body sections including at least one transition body section and a pair of end body sections, each of said end body sections being truncated so as to present a contoured outer end surface that is intersected by an end joining face, with the outer end surface defining part of the body surface at one of the body ends, said end joining faces of the end body sections having different marginal shapes and/or sizes, said at least one transition section presenting a contoured outer transition surface that defines part of the body surface between the body ends, said at least one transition section including opposite, endmost transition joining faces that intersect the outer transition surface, each endmost transition joining face marginally matching in shape and size a respective one of the end joining faces to define a connection interface, such that the transition joining faces are different from one another in marginal shape and/or size, said joining faces associated with each connection interface being substantially coterminous so that the body surface extends substantially continuously across the connection interfaces and the outer transition surface provides a smooth transition from one of the connection interfaces to the other one of the connection interfaces.

21. The modular construction toy as claimed in claim 20, each outer end surface presenting a substantially frusto-spherical shape.

22. The modular construction toy as claimed in claim 20, said joining faces of each connection interface being in flush engagement with one another.

23. The modular construction toy as claimed in claim 20, said joining faces being substantially planar.

24. The modular construction toy as claimed in claim 20; and a plurality of connectors releasably interconnecting corresponding ones of the body sections.

25. The modular construction toy as claimed in claim 24, each of said connectors corresponding with a respective connection interface, each of said connectors comprising a peg associated with one of the corresponding body sections of the respective connection interface, with the other body section of the respective connection interface including a bore removably receiving the peg.

26. The modular construction toy as claimed in claim 25, said peg projecting outwardly from the joining face of the one body section, said bore extending inwardly from the joining face of the other body section.

27. The modular construction toy as claimed in claim 26, said one body section including an inwardly extending bore that removably receives the peg, such that the peg is removable from both body sections of the respective connection interface.

28. The modular construction toy as claimed in claim 27, said bores associated with the respective connection interface being axially aligned, said peg including axially aligned portions received in the bores associated with the respective connection interface.

29. The modular construction toy as claimed in claim 27, each of said body sections of the respective connection interface including a plurality of said bores, with each bore of the one body section aligning with a corresponding bore of other body section.

30. The modular construction toy as claimed in claim 20, said body sections including more than two of the end body sections, with the end body sections being variously sized and shaped.

31. The modular construction toy as claimed in claim 20, said endmost transition joining faces defining an oblique angle therebetween.

32. The modular construction toy as claimed in claim 20, said body sections including multiple transition body sections, each of which is provided with the opposite transition joining faces, said transition body sections being variously sized and shaped.

33. The modular construction toy as claimed in claim 32, at least one pair of said transition body sections including substantially coterminous transition joining faces so as to define one of the connection interfaces.

34. The modular construction toy as claimed in claim 20, each of said body sections having a plurality of inwardly extending bores spaced about the outer surface thereof; and a peg removably received in one of the bores so that a first body section is connected to a second body section along the outer surface of the second body section.

35. The modular construction toy as claimed in claim 34, said body sections including a plurality of section sets, each of which includes a respective pair of the end sections and at least one transition section such that each set defines a separate toy body, said separate toy bodies being connected along the outer surfaces thereof.

36. The modular construction toy as claimed in claim 20, said body sections including an appendage body section that is devoid of one of the joining faces, said appendage body section being connected to one of the other body sections.

37. The modular construction toy as claimed in claim 36, at least one of said body sections having a bore extending inwardly from the outer surface thereof; and a peg associated with the appendage body section, said peg being received in the bore so that the appendage body section is connected to the at least one body section along the outer surface thereof.

38. The modular construction toy as claimed in claim 20, said outer transition surface projecting from at least one of the endmost transition joining faces at an oblique angle.

* * * * *